US009939146B1

(12) United States Patent
Palusky et al.

(10) Patent No.: US 9,939,146 B1
(45) Date of Patent: Apr. 10, 2018

(54) MEDIA PLAYER DEVICE WITH FOREGROUND ILLUMINATING FLASHLIGHT

(71) Applicant: RENEW WORLD OUTREACH, INC., Stone Mountain, GA (US)

(72) Inventors: David Palusky, Stone Mountain, GA (US); Christopher Vollo, Stone Mountain, GA (US); Michael Shivers, Stone Mountain, GA (US)

(73) Assignee: RENEW WORLD OUTREACH, INC., Stone Mountain, GA (US)

( * ) Notice: Subject to any disclaimer, the term of this patent is extended or adjusted under 35 U.S.C. 154(b) by 0 days.

(21) Appl. No.: 15/799,148

(22) Filed: Oct. 31, 2017

(51) Int. Cl.

| | |
|---|---|
| ***H04R 1/02*** | (2006.01) |
| ***F21V 33/00*** | (2006.01) |
| ***F21V 23/04*** | (2006.01) |
| ***F21L 4/00*** | (2006.01) |
| *F21Y 115/10* | (2016.01) |

(52) U.S. Cl.
CPC ..... *F21V 33/0056* (2013.01); *F21L 4/005* (2013.01); *F21V 23/0414* (2013.01); *H04R 1/026* (2013.01); *H04R 1/028* (2013.01); *F21Y 2115/10* (2016.08); *H04R 2420/09* (2013.01); *H04R 2499/11* (2013.01)

(58) Field of Classification Search
CPC ..... H04R 1/025; H04R 1/026; H04R 1/028; H04R 2420/07; H04R 2499/11; A45F 2005/006; F21V 33/00; F21V 33/0056; F21V 23/0414; F21Y 2115/10; F21L 4/005
See application file for complete search history.

(56) References Cited

U.S. PATENT DOCUMENTS 4,959,637 A * 9/1990 Woods ..... F21V 33/0076 340/321
5,055,986 A * 10/1991 Johnson ..... F21S 9/022 362/183

(Continued)

OTHER PUBLICATIONS

ReadyLight Solar Power Rechargeable Flashlight, SKU: VB03WW4, Verilux, downloaded from: https://verilux.com/store/readylight-solar-power-rechargeable-flashlight?utm_medium=cpc&utm_source=bing on Oct. 31, 2017, 4 pages (pp. 1-4 in pdf).

*Primary Examiner* — Thang Tran
(74) *Attorney, Agent, or Firm* — Mitch Harris, Atty at Law, LLC; Andrew M. Harris

(57) ABSTRACT

A media player device having an integrated ground-illuminating flashlight provides hands-free ground illumination while walking. The media player device includes a lanyard attached to a first end of a housing, a first lamp located at a second end of the housing for use as an ordinary flashlight, and a second lamp located on a front side of the housing and directed at an acute angle from the housing toward the second end of the housing, so that the ground in front of a wearer of the media player device is illuminated. A speaker for reproducing the audio generated by the media player device may also be located on the front of the housing to provide audibility of the playback audio, or may alternatively be located on the first end or side of the housing. Controls are provided on the front or side of the housing to provide easy access when wearing the device.

23 Claims, 13 Drawing Sheets

(56) References Cited

U.S. PATENT DOCUMENTS

| | | | | |
|---|---|---|---|---|
| 5,887,550 | A * | 3/1999 | Levine | A01K 27/004 119/796 |
| 6,926,451 | B2 * | 8/2005 | Cauwels | G02B 6/4292 385/100 |
| 9,277,103 | B1 * | 3/2016 | Hales | H04N 5/2253 |
| 2006/0028811 | A1 * | 2/2006 | Ross, Jr. | F21V 33/0052 362/157 |
| 2006/0197656 | A1 * | 9/2006 | Sergio | A61H 31/005 340/539.11 |
| 2008/0224988 | A1 * | 9/2008 | Whang | G09G 3/3406 345/102 |
| 2012/0220256 | A1 * | 8/2012 | Tsuge | F21L 4/04 455/343.1 |
| 2016/0196736 | A1 * | 7/2016 | Nolan | G08B 25/016 340/6.1 |

* cited by examiner

MEDIA PLAYER DEVICE WITH FOREGROUND ILLUMINATING FLASHLIGHT

BACKGROUND OF THE INVENTION

1. Field of the Invention

The present invention relates generally to a media player device having an integrated flashlight that illuminates the ground in front of a wearer.

2. Description of the Related Art

Portable audio playback devices incorporating various other features are in widespread use. Modern mobile telephones such as smartphones provide media playback, as well as the capability to provide a low power flashlight suitable for close work by using light-emitting diodes (LEDs) provided for enabling camera features such as auto-focus. However, smartphone "flashlights" are not typically suitable for walking and hiking in dimly-lit or dark areas. Flashlights used for such purposes are generally hand-held or mounted on a hat and their beams are then directed at the ground in front of the user by pointing the flashlight at the ground.

It would therefore be desirable to provide a media player device having a more powerful flashlight capability, and in particular, a media player device suitable for illuminating the ground ahead of a walker or hiker.

SUMMARY OF THE INVENTION

The objective of providing a media player device with a flashlight capability for illuminating the ground ahead of a walker or hiker is provided in a media player device having an integrated ground-illuminating flashlight.

The media player device includes a housing having a lanyard mount at a first end of the housing, which may be formed through a hook provided for suspending the media player device by the first end of the housing. The media player device includes a speaker mounted to and within the housing for reproducing an audio output signal, a memory within the housing for storing the recorded audio programs and an audio rendering circuit for reading the recorded audio programs from the memory and generating the audio output signal. The media player device also includes a first lamp provided at a face of the housing and directed outward at an acute angle with respect to the length of the face of the housing extending between the first end of the housing and a second end of the housing opposite the first end, so that the first lamp provides an illumination beam directed in front of the user's feet when the lanyard is passed around the user's neck. The media player device also includes a battery for supplying operating current to the first lamp and to the audio rendering circuit.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure includes a media player device with an integrated lighting device for use when hiking, camping, meetings in locations without sufficient external lighting and other occasions that might be encountered by missionaries or other users. The media player device can be used to play back music, sermons, biblical passages, and other content that is suitable for the above uses, or other audio recorded media that the user might want to transfer to the media player device for later playback.

Figure 1A:
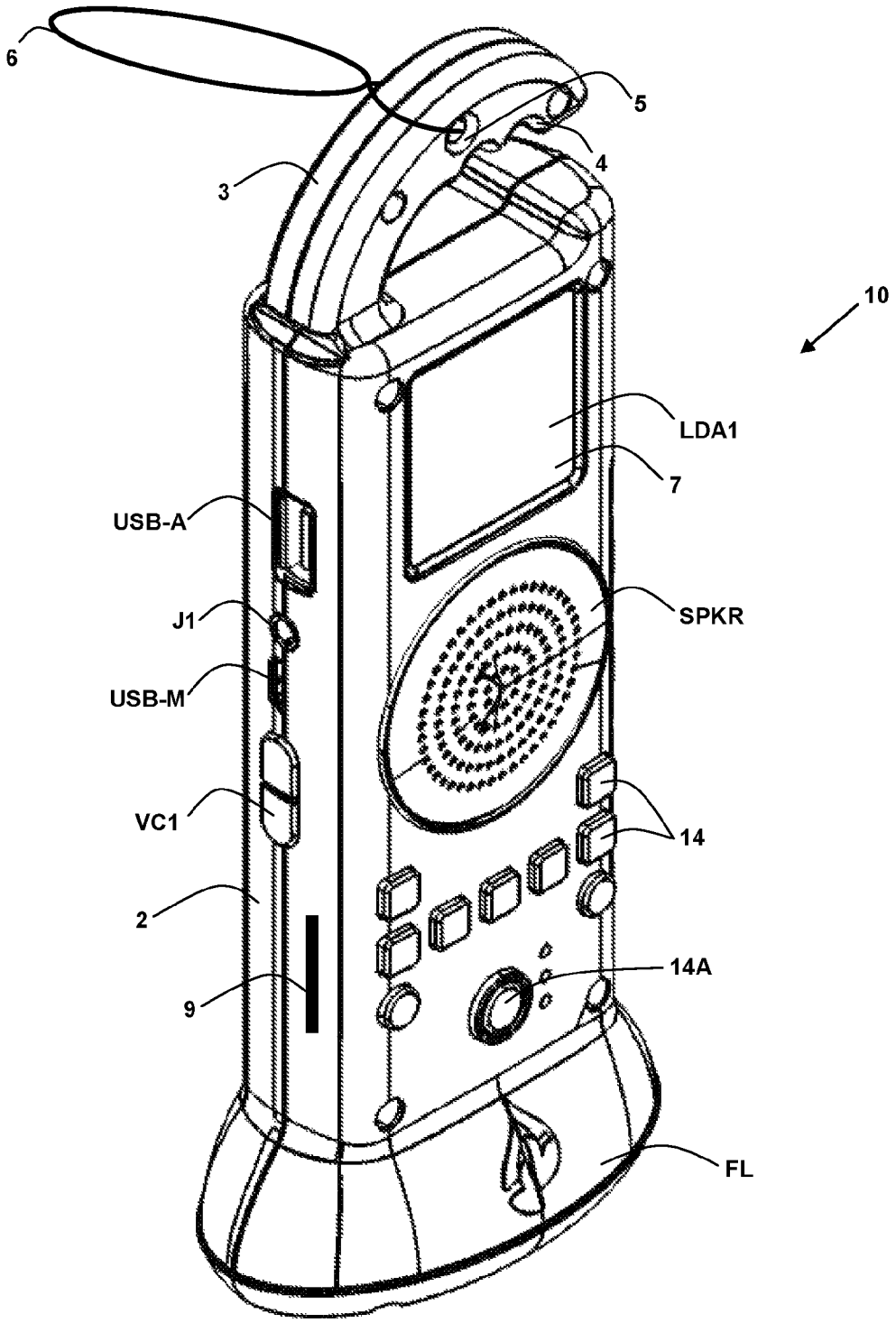
FIG. 1A is a front left perspective view.
Figure 1B:
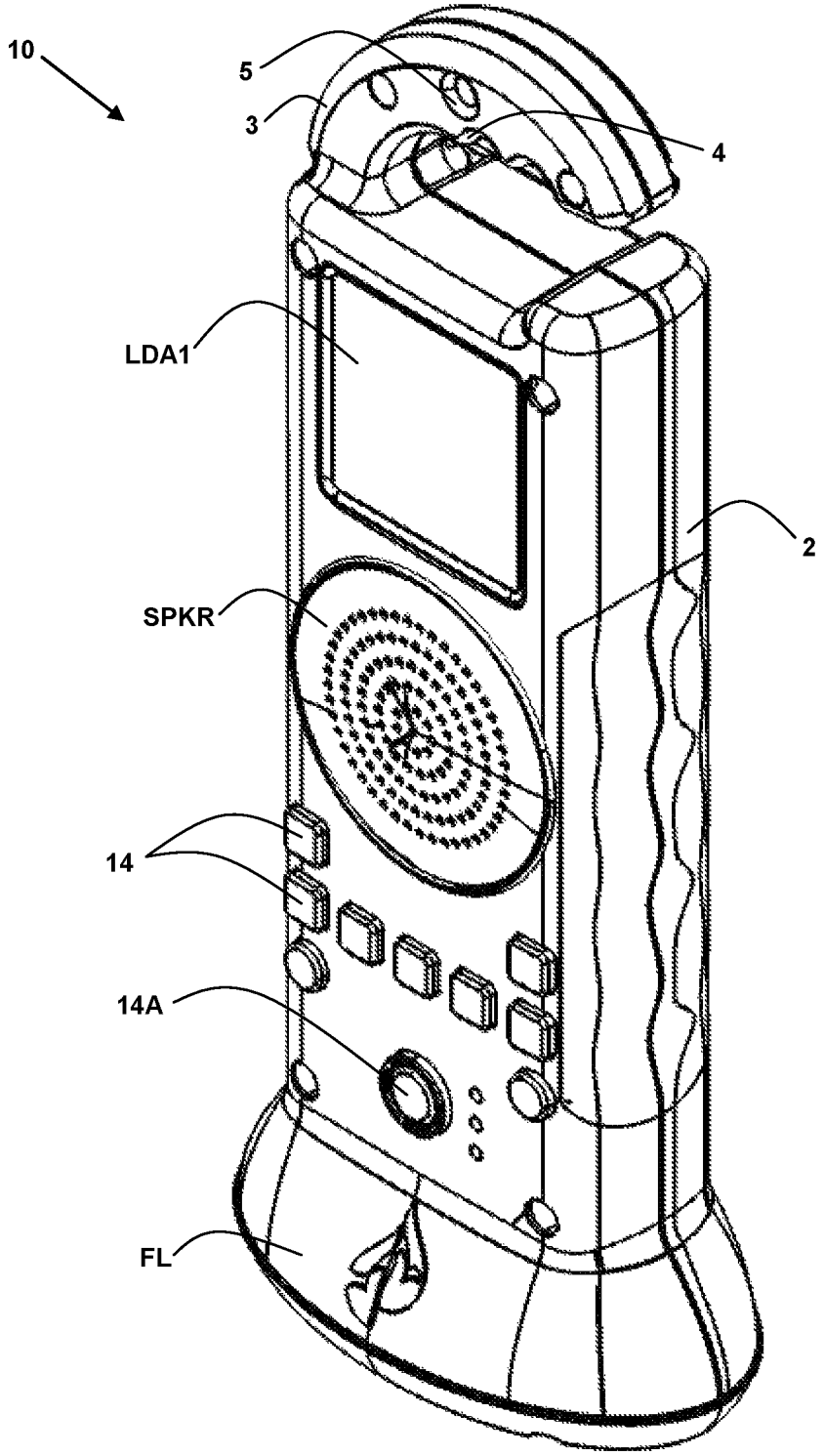
FIG. 1B is a front right perspective view.
Figure 1C:
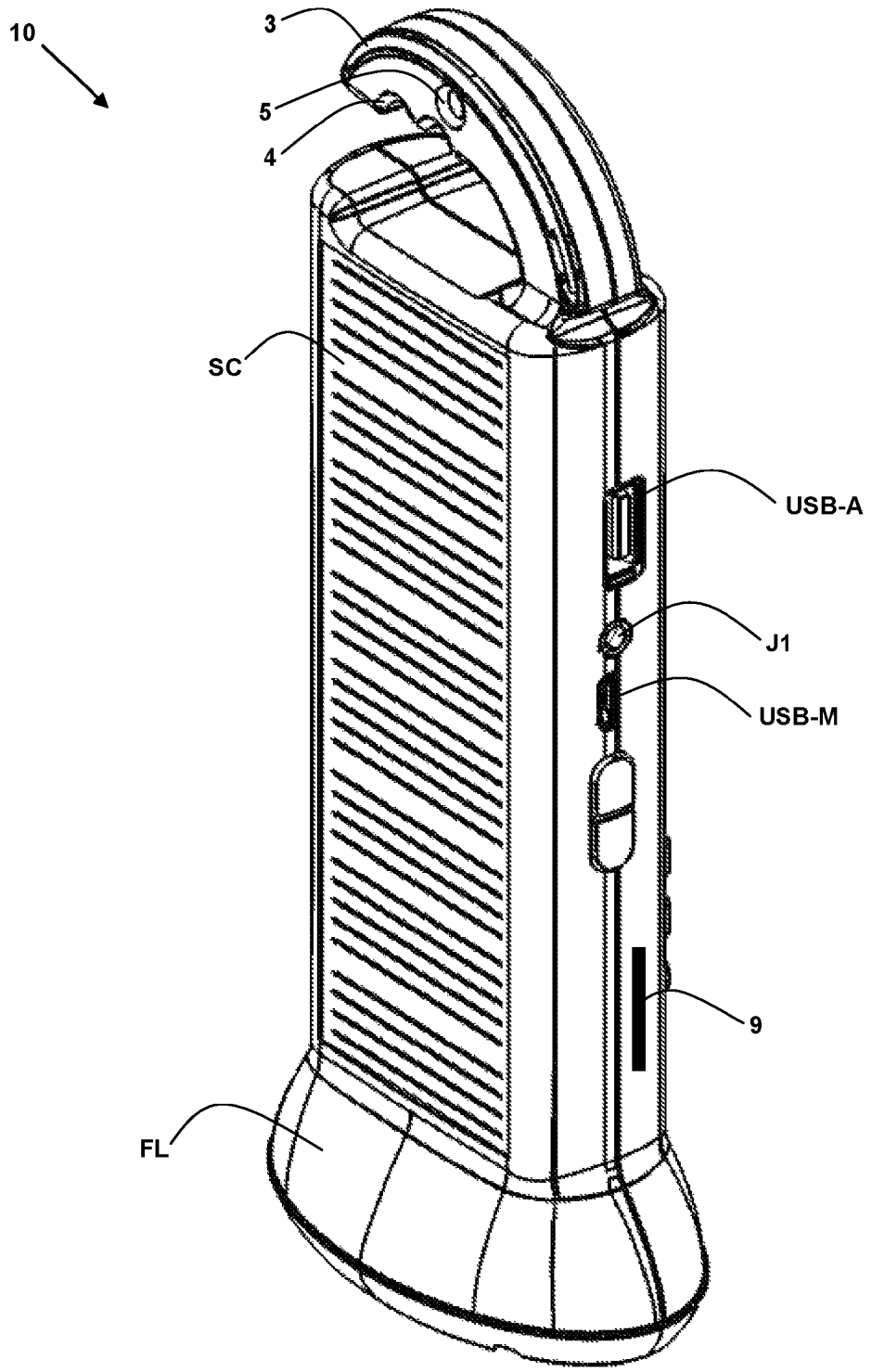
FIG. 1C is a back right perspective view.
Figure 1D:
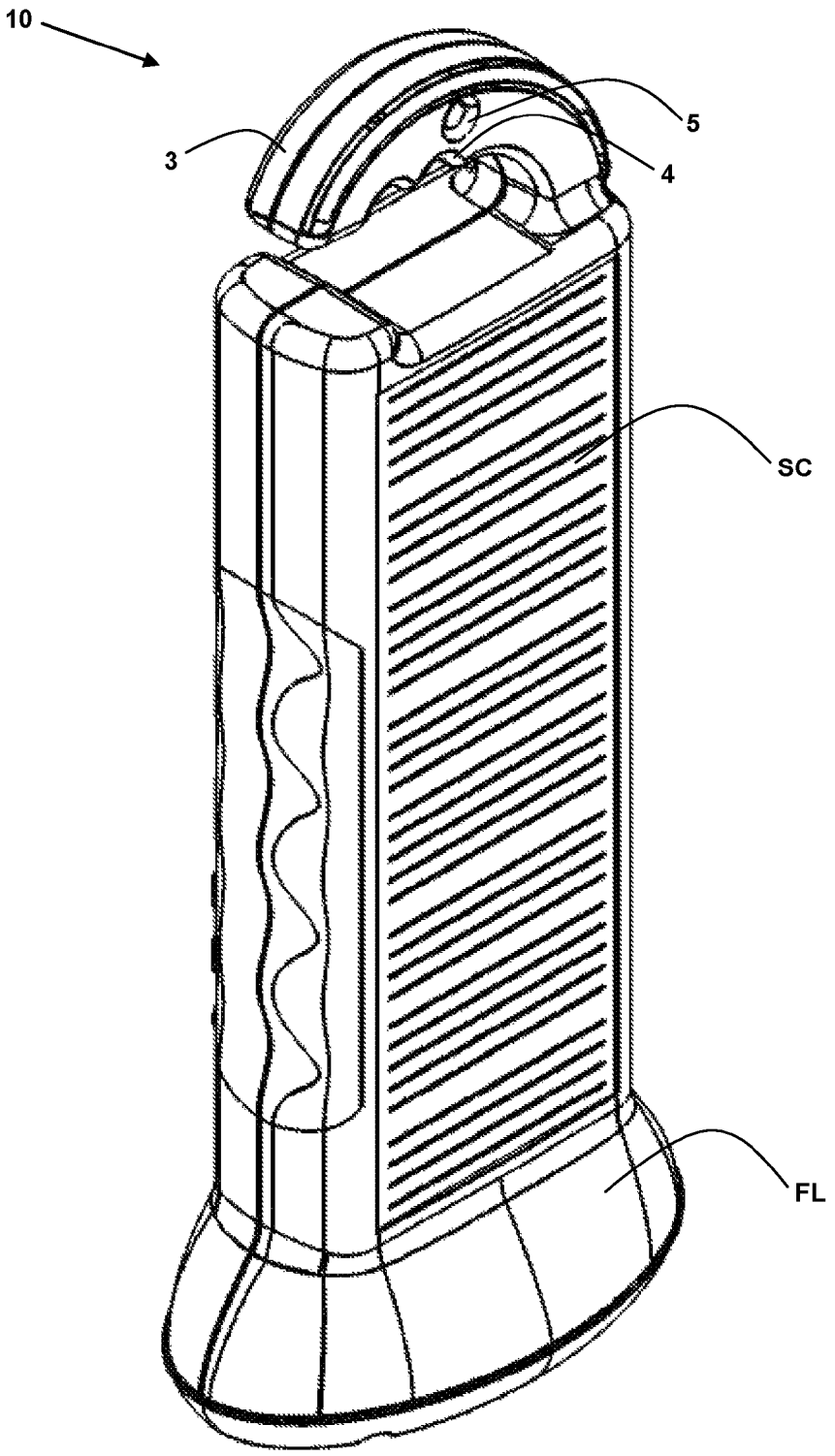
FIG. 1D is a back left perspective view showing an example of a media player device 10 as disclosed herein.

Referring now to FIGS. 1A-1D, an illustrative example of a media player device 10 is shown in a front left perspective view, a front right perspective view, a back right perspective view, and a back left perspective view, respectively. Media player device 10 incorporates both media player and lighting functionality, including a flashlight assembly FL and a ground/environment light-emitting diode (LED) array LDA1, covered by a transparent plastic window 7. A speaker SPKR provides a first audio output capability, which is disconnected when an audio headset is connected to a jack J1, providing private listening capability. A set of pushbuttons 14 provides for control of functions of media player device 10 including selection of program material. A light control button 14A controls the operation of flashlight FL and LED array LDA1, selecting between them or selecting both. Light control button 14A may also select lighting levels for LED array LDA1 by controlling a current supplied to LED array LDA1. A volume control VC1 provides control of the amplitude of the audio signal reproduced by speaker SPKR or provided to jack J1. Two universal serial bus (USB) connectors are provided on a housing 2 of media player device 10, a USB micro connector USB-M provides for charging of a rechargeable battery B1 (not shown) within media player device 10 and for upload/download of media files to a memory 22 (not shown) within media player device 10. A second type-A USB connector USB-A provides current for charging external USB devices connected to USB connector USB-A. A Secure Digital (SD) card slot 9 is provided for insertion of an SD card containing media for transfer to or from media player device 10. SD card slot 9 is an example of a media card slot, and other formats may be supported by SD card slot 9 or SD card slot 9 may be replaced with a card slot for another media type. A hook 3 provided at the top of housing 2 provides for suspending media player device 10 from a rod or rope and includes ridges 4 to keep hook 3 from slipping out of position on the suspension. A lanyard hole 5 is provided for connection of a lanyard 6, which may be sufficiently long for use as a neck lanyard or may be a shorter wrist strap. Use of a neck lanyard as lanyard 6 provides one of the functions of media player device 10 as a ground lighting device. LED array LDA1 is oriented so that light is directed downward from transparent plastic window 7 at an acute angle appropriate for lighting the ground ahead of the feet of a wearer, which in the particular example is 45 degrees away from the length of housing 2 (i.e., the length extending between hook 3 and flashlight assembly FL) extending outward from flashlight assembly FL. Referring to FIGS. 1C-1D, on the back face of housing 2, a solar cell array SC is provided for recharging internal battery B1 (not shown).

Figure 2:
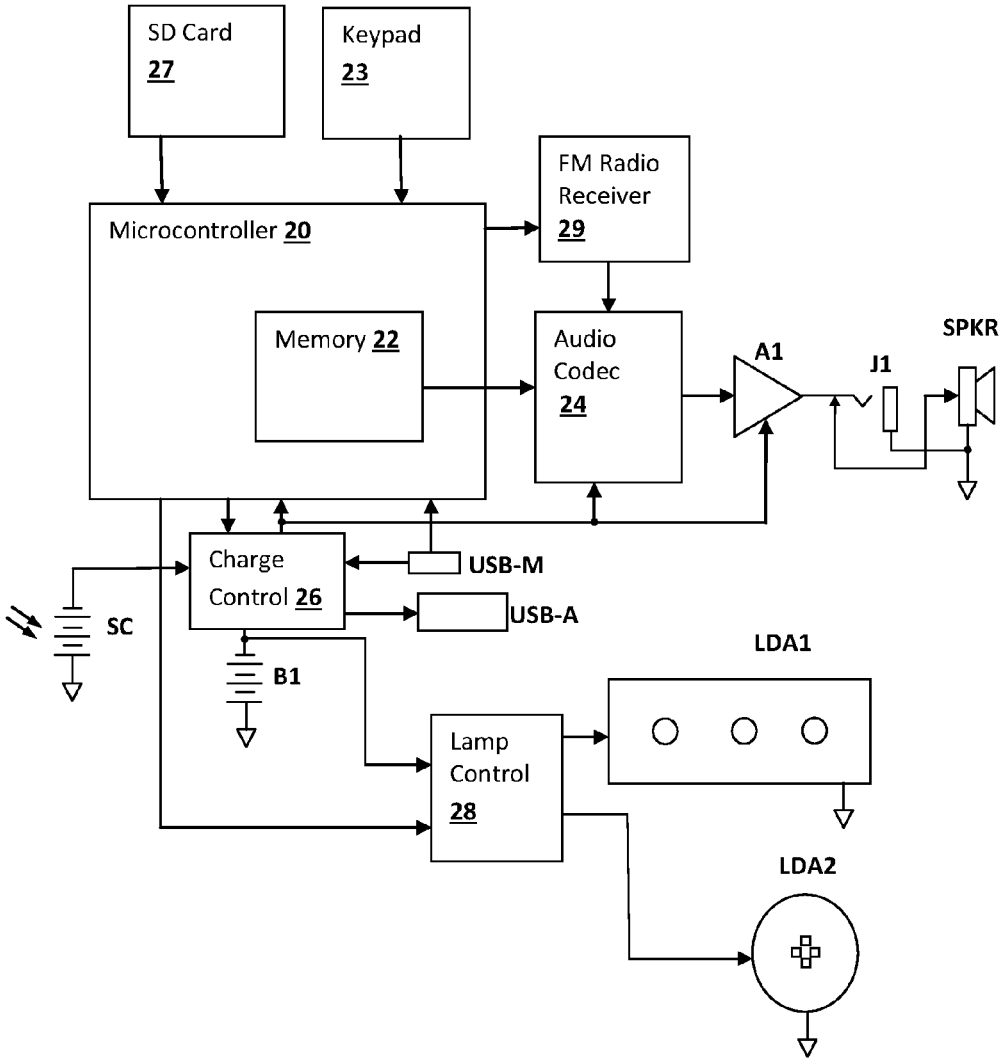
FIG. 2 is a block diagram of circuits within media player device 10 of FIGS. 1A-1D.

Referring now to FIG. 2, a block diagram of circuits within media player device 10 is shown. A microcontroller 20, which may be a general-purpose microcontroller, or a special-purpose audio controller, provides control of the functions of media player device 10. Memory 22 within (or alternatively external to) microcontroller 20, provides program instructions directing the operation of media player device 10 including the control of current supplied to LED array LDA1 and another LED array LDA2, which is part of flashlight assembly FL and provides the light directed from flashlight assembly FL. A lamp control circuit 28 is provided to control the supplied current and to switch between operation of flashlight lighting provided by LED array LED2 and ground/environment light provided by LED array LED1. Alternatively, LED array LDA1 and LED array LDA2 may be operated by simple circuits associated with light control button 14A. For example, light control button 14A can be used to select between operating LED array LDA1 or LED array LDA2 or both, and may select the level of intensity for either of LED array LDA1 or LED array LDA2 in steps. Alternatively selection of which of LED array LDA1 and LED array LDA2 to illuminate and/or selection of intensity may be performed in part via keypad 23.

A charge control circuit 26 provides charging of battery B1 from either USB-micro connector USB-M or solar cell array SC and also provides charging current supplied from USB connector USB-A. An audio codec 24, which may be integrated within microcontroller 20, provides an audio output signal (or signals for stereo operation via jack J1) to an amplifier A1, which provides the final audio output signal(s) to jack J1 or speaker SPKR. Alternatively, amplifier A1 may be omitted if the output signal from audio codec 24 or microcontroller 20 is of sufficient amplitude, e.g., a full-voltage pulse-width modulated (PWM) output signal provided from microcontroller 20. A frequency modulation (FM) radio receiver 29 is coupled to audio codec 24 for providing commercial radio functionality to media player device 10 as an alternative to playback of stored program media within memory 22, and optionally from an SD card 29 inserted in SD card slot 9. As mentioned above, a keypad 23 implemented by pushbuttons 14, including volume control VC1, and optionally including light control button 14A, provides user inputs for control of media player device 10 functions via microcontroller 20.

USB connector USB-A may operate in either device mode or host mode for USB On-the-Go (OTG) operation of certain devices. In device mode, media stored within memory 22 can be mapped as a storage device, and the storage device functionality provided through USB connector USB-A for transfer of media to and from memory 22. Optionally, media stored on SD card 29 may be mapped as a storage device, allowing use of media player device 10 as an SD card reader. The provision of media mapping may be selectively protected, i.e., some media or other files stored in memory 22 may not be mapped to the storage device provided at USB connector USB-A, while the protected media or media types may be writable via the storage device provided at USB connector USB-A to provide write-only capability for some files. In host mode USB connector USB-A can transfer media or other files to a storage device connected to USB connector USB-A, e.g., a USB flash memory drive "USB stick." The media available for transfer may also be protected in host mode, so that not all media is available for transfer outside of media player device 10. In some embodiments, USB-micro connector USB-M can provide device mode capability, so that two media player devices 10 can be connected together. A first media player device 10 can interrogate a device connected at USB connector USB-A operating in host mode and if another (proprietary) media player device 10 connected via its USB-micro connector USB-M is identified by vendor ID/device ID or other identifying communications after connection, the second media player can be initialized or updated, all media can be transferred, selected media can be transferred or only unprotected media can be transferred, depending on the desired function.

Figure 3:
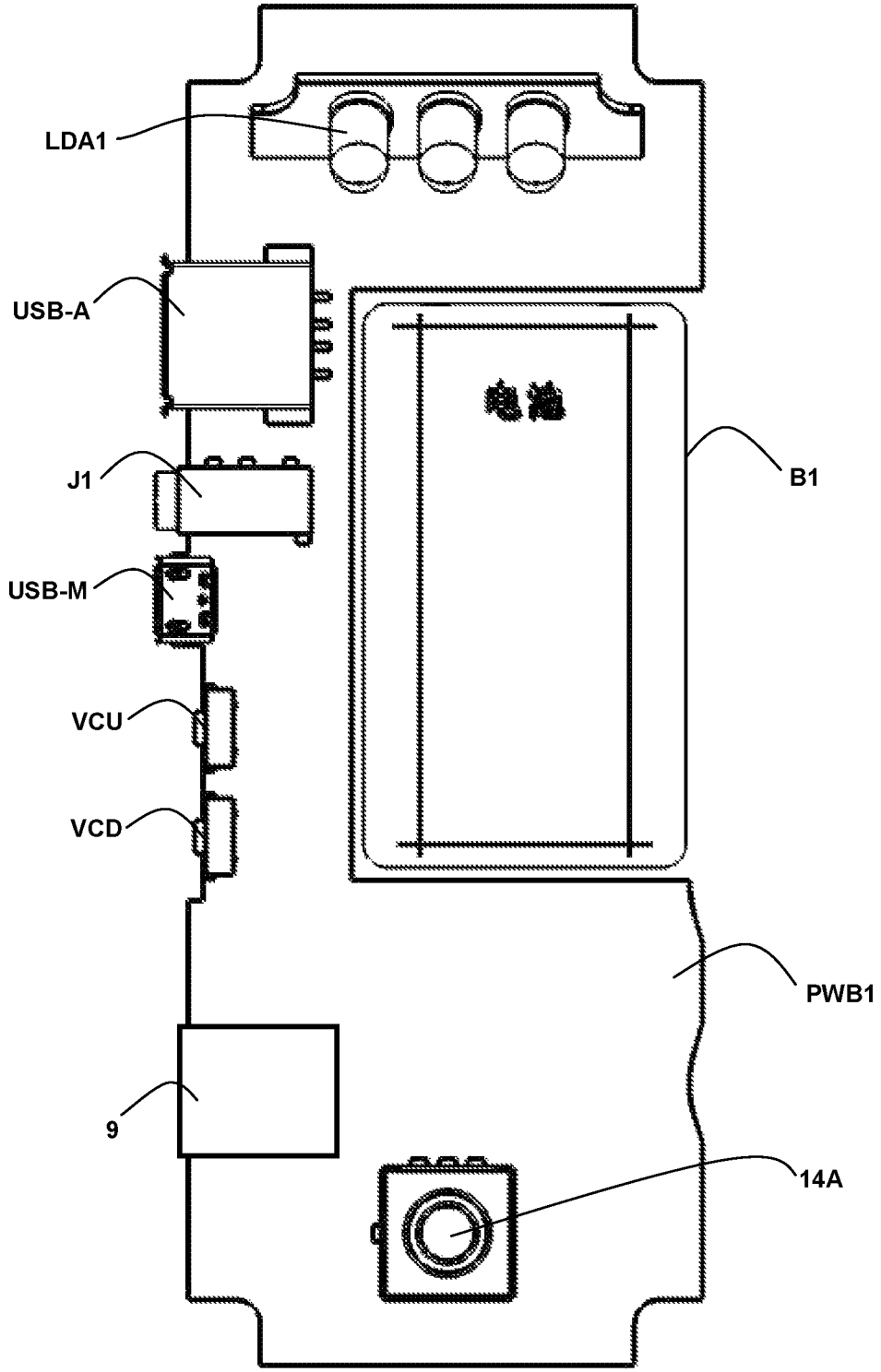
FIG. 3 is a front view of a printed wiring board (PWB) PWB1 and associated circuits within media player device 10 of FIGS. 1A-1D.

Referring now to FIG. 3, a front view of a PWB PWB1 within media player device 10 is shown. PWB PWB1 provides mounting for, and interconnection of, the circuits illustrated in the block diagram of FIG. 2. Battery B1 mounts in a cut-out of PWB PWB1 to provide lower package height and is connected to PWB PWB1, e.g., by wires (not shown). A pair of switches VCD, VCU implements volume control VC1 of media player device 10, which includes a plastic rocker of volume control VC1 (as seen in FIGS. 1A and 1C) that alternatively contacts switches VCD, VCU. USB connectors USB-M and USB-A, SD card slot 9 and jack J1 are mounted at the left edge of PWB PWB1 so that their connection points can protrude through their corresponding apertures into housing 2. LED array LDA1 is mounted on PWB PWB1 as is light control button 14A.

Figure 4:
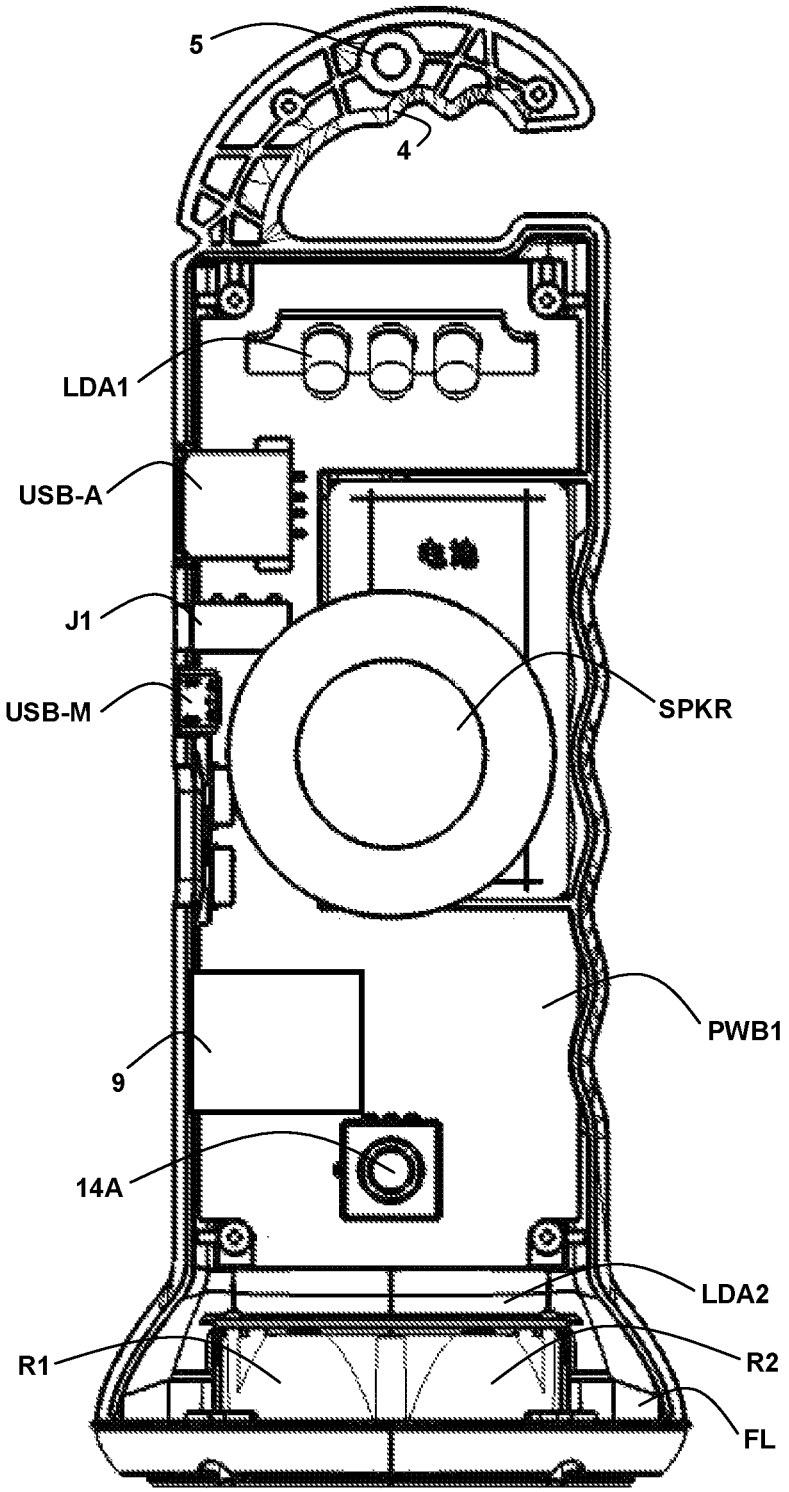
FIG. 4 is an internal front view of media player device 10 of FIGS. 1A-1D.
Figure 5A:
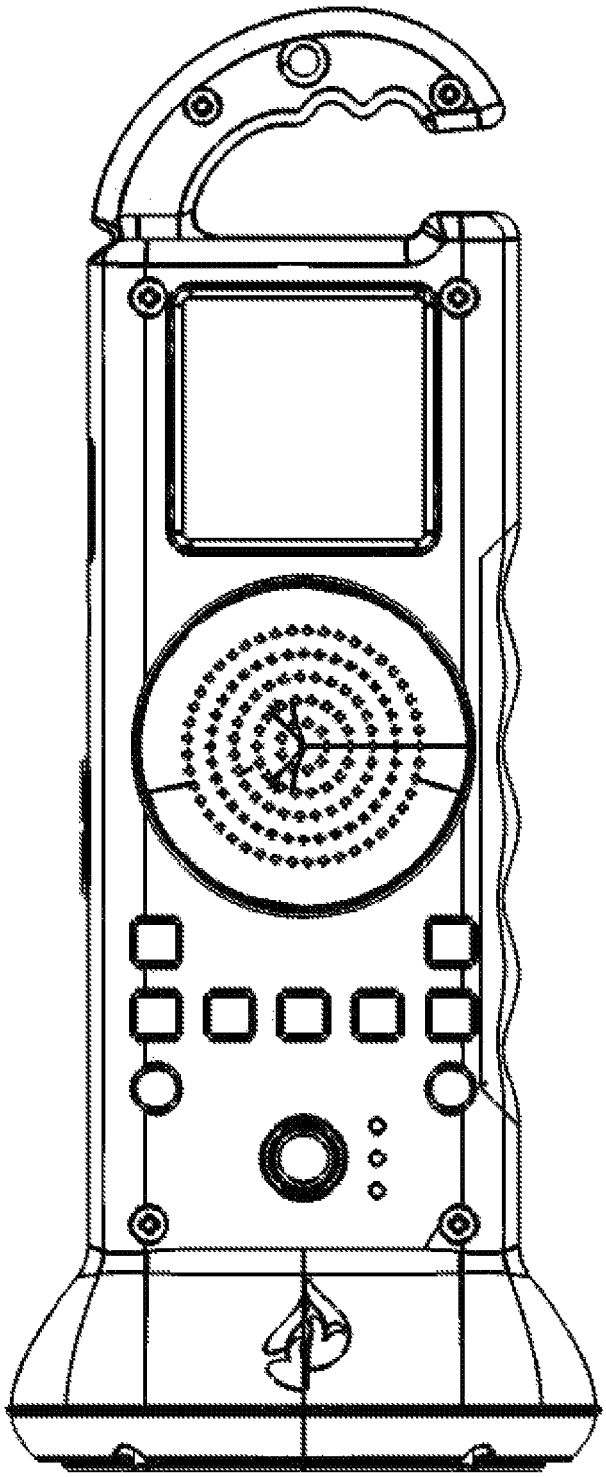
FIGS. 5A-5F are a front view, a back view, a left side view, a right side view, a top view and a bottom view, respectively, illustrating design elements of media player device 10 of FIGS. 1A-1D.
Figure 5B:
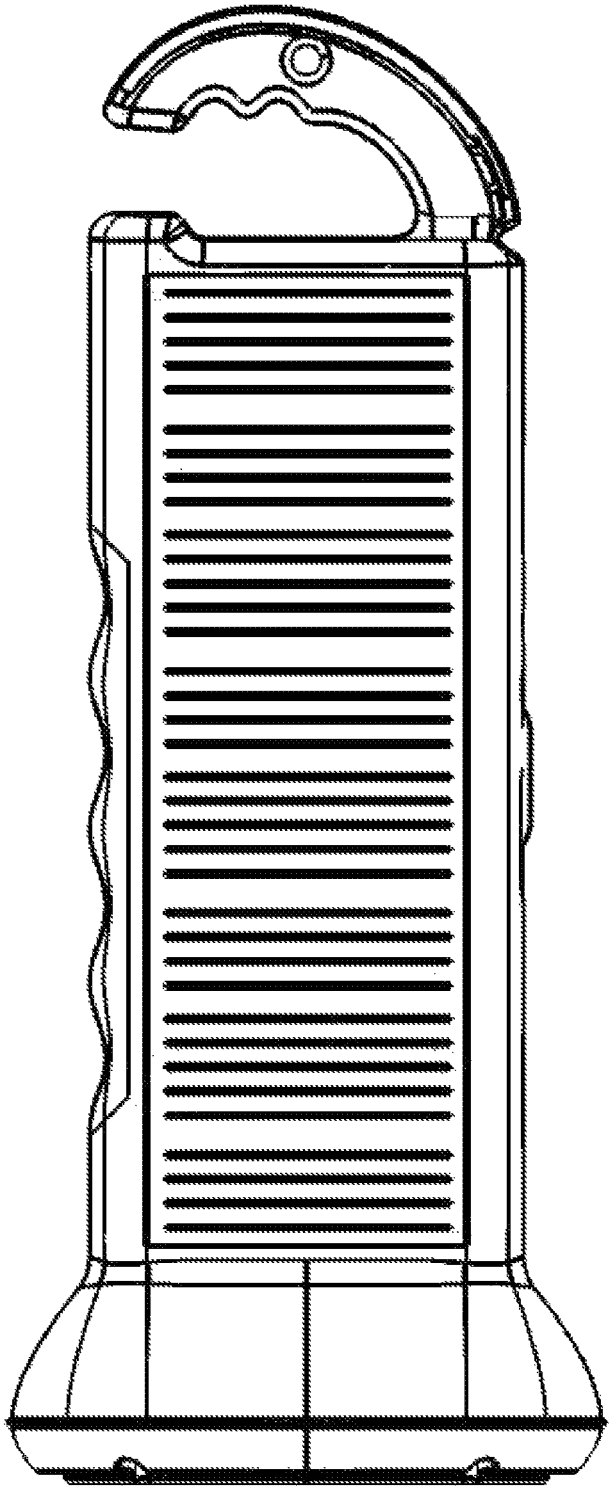
Figure 5C:
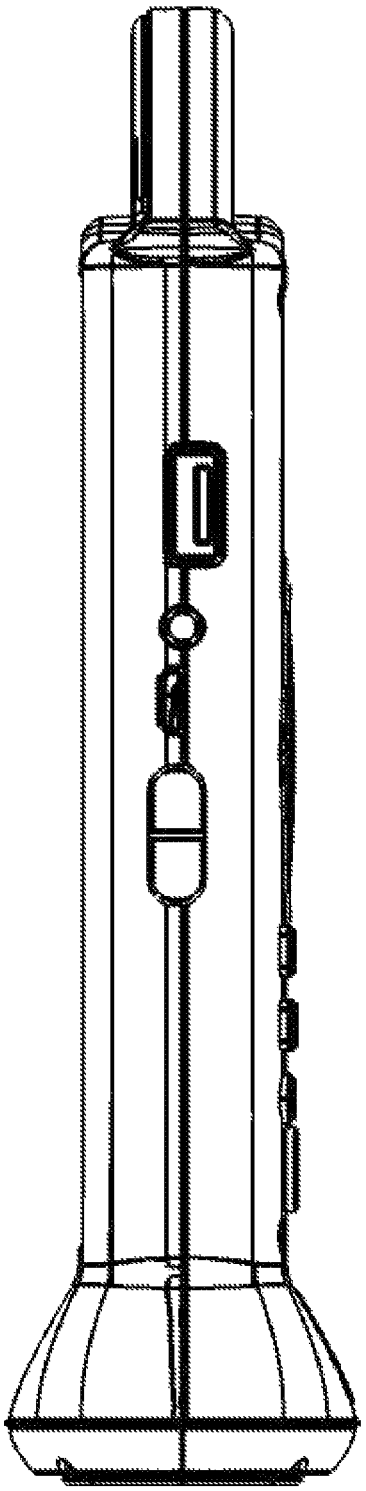
Figure 5D:
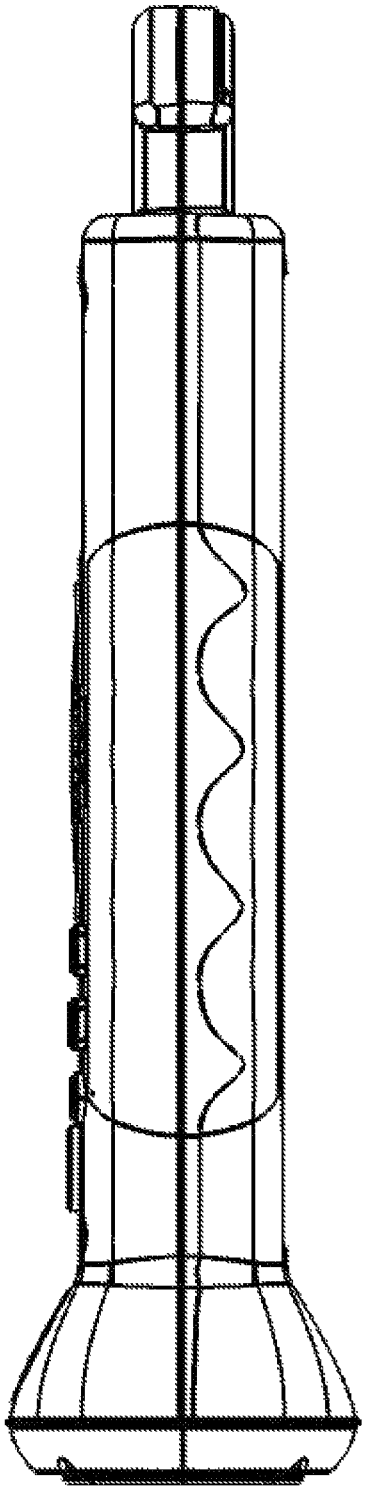
Figure 5E:
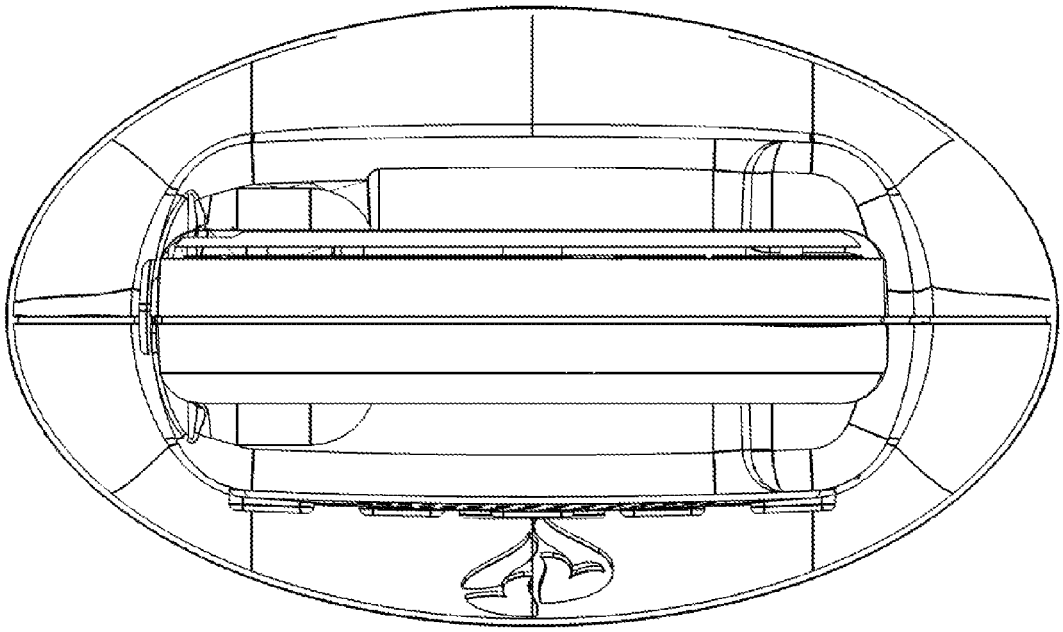
Figure 5F:
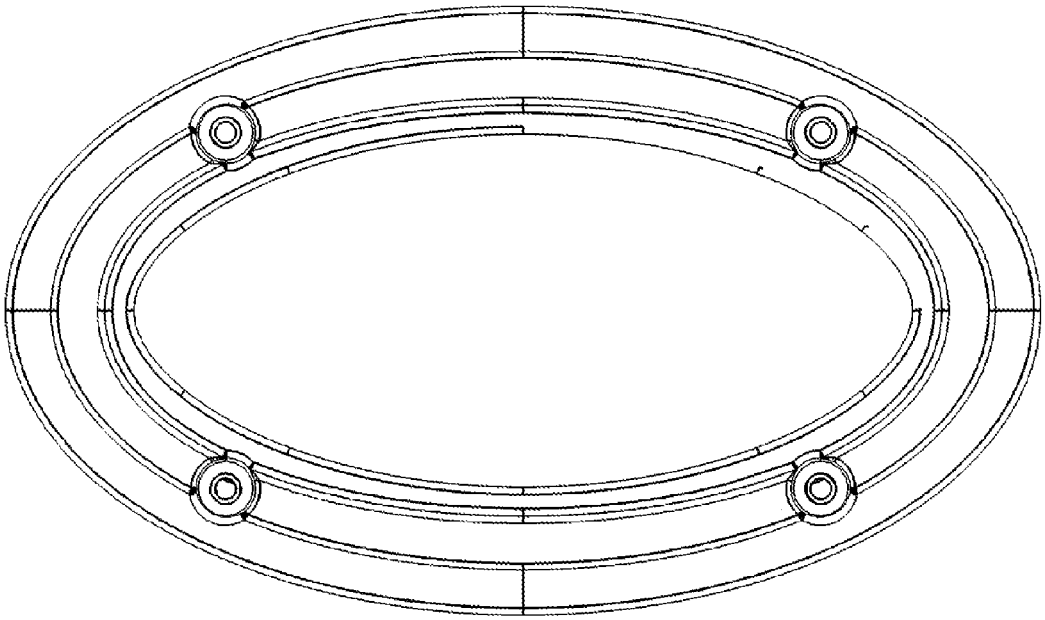

Referring now to FIG. 4, an internal view of media player device 10 is shown, with the front portion of housing 2 removed and showing mounting of the various structures, including PWB PWB1 as described above. The location of LED array LDA2 is shown, and a pair of reflectors R1, R2 are provided below LED array LDA2 as part of flashlight assembly FL, to focus light provided by LED array LDA2 to form a flashlight beam.

Referring to FIGS. 5A-5F, design elements of media player device 10 are shown in a front view, a back view, a left side view, a right side view, a top view and a bottom view, respectively.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A media player device, comprising:

a housing having a lanyard mount disposed at a first end thereof, whereby the housing is suspendable from the lanyard when the lanyard is passed around a neck of a user;

a speaker mounted to and within the housing for reproducing an audio output signal;

a memory within the housing for storing recorded audio programs;

an audio rendering circuit within the housing, wherein the audio rendering circuit is coupled to the memory and further coupled to the speaker for reading the recorded audio programs and generating the audio output signal;

a first lamp disposed at a face of the housing and directed outward at an acute angle with respect to the length of the face of the housing extending between the first end of the housing and a second end of the housing opposite the first end, whereby the first lamp provides an illumination beam directed in front of the feet of the user when the lanyard is passed around the neck of the user; and a battery for supplying operating current to the first lamp and to the audio rendering circuit.

2. The media player device of claim 1, wherein the first lamp comprises a plurality of light-emitting diodes disposed behind a transparent window conforming to the face of the housing.

3. The media player device of claim 2, wherein the acute angle is less than 50 degrees.

4. The media player device of claim 3, wherein the acute angle is substantially equal to 45 degrees.

5. The media player device of claim 2, wherein the plurality of light-emitting diodes are arranged in a line having direction extending across the face of the housing perpendicular to the length of the face of the housing.

6. The media player device of claim 1, further comprising a second lamp including a reflector disposed at the second end of the housing, wherein the reflector faces away from the housing at the second end thereof.

7. The media player device of claim 6, wherein the speaker is mounted to a back of the face of the housing.

8. The media player device of claim 6, further comprising a plurality of controls for operating the first lamp, the second lamp and the audio rendering circuit and disposed on the housing.

9. The media player device of claim 8, wherein the first lamp is disposed on the face of the housing proximate the first end of the housing, the controls are disposed on the face of the housing proximate the second lamp, and the speaker is mounted behind the face of the housing between the controls and the first lamp.

10. The media player device of claim 6, wherein the housing has a plurality of grip notches formed on a side thereof for accommodating fingers of the user when gripped as a flashlight when using the second lamp.

11. The media player device of claim 1, wherein the housing forms a hook portion at the first end thereof for suspending the media player device, and wherein the lanyard mount is provided by a hole formed through the hook portion of the housing.

12. The media player device of claim 11, wherein the hook has a plurality of steps formed on a lower inner surface facing the housing.

13. The media player device of claim 1, further comprising a processor within the housing and coupled to the memory, wherein the audio rendering circuit is provided by the processor executing program instructions stored in the memory for reading the audio programs stored in the memory and providing the audio programs to codec for generating the audio output signal.

14. The media player device of claim 13, further comprising a secure digital (SD) card connector provided at the housing and coupled to the processor, and wherein the program instructions further read audio program information from the SD card and provide the audio program information to the codec or copy the audio program information to the memory.

15. The media player device of claim 13, further comprising:

a standard universal serial bus (USB) connector at the housing, wherein the program instructions further comprise program instructions for connecting to an external host for transferring files from the external host to the memory; and a micro-USB connector for supplying current re-charging the battery, and wherein the program instructions further comprise program instructions for implementing an internal host over the micro-USB connector, and program instructions upon detecting connection of another media player device, transferring recorded audio programs from the memory to the another media player device.

16. A media player device, comprising:

a housing having a lanyard mount disposed at a first end thereof, whereby the housing is suspendable from a lanyard connected to the lanyard mount when the lanyard is passed around a neck of a user;

a speaker mounted to and within the housing for reproducing an audio output signal;

a memory within the housing for storing recorded audio programs;

an audio rendering circuit within the housing, wherein the audio rendering circuit is coupled to the memory and further coupled to the speaker for reading the recorded audio programs and generating the audio output signal;

a plurality of light-emitting diodes disposed behind a transparent window conforming to a face of the housing and directed outward at an angle less than 50 degrees with respect to the length of the face of the housing extending between the first end of the housing and a second end of the housing opposite the first end, whereby the plurality of light-emitting diodes provides an illumination beam directed in front of the feet of the user when the lanyard is passed around the neck of the user;

a second lamp including a reflector disposed at the second end of the housing, wherein the reflector faces away from the housing at the second end thereof, wherein a first lamp comprises a plurality of light-emitting diodes disposed behind the transparent window conforming to the face of the housing; and a battery for supplying operating current to the first lamp, to the second lamp and to the audio rendering circuit.

17. A method of playing back a recorded audio program while providing illumination of a ground in front of a user, the method comprising:

suspending a housing from a first end using a lanyard mounted to a lanyard mount of the housing and passed around a neck of the user;

playing back the recorded audio program via a speaker mounted to and within the housing by generating an audio output signal by an audio rendering circuit coupled to a memory storing the recorded audio program;

lighting the ground in front of the person with a lamp integrated in the housing and directed outward at an acute angle with respect to the length of the face of the housing extending between the first end of the housing and a second end of the housing opposite the first end, whereby the first lamp provides an illumination beam directed in front of the feet of the user.

18. The method of claim 17, wherein the first lamp comprises a plurality of light-emitting diodes disposed behind a transparent window conforming to the face of the housing.

19. The method of claim 18, wherein the acute angle is less than 50 degrees.

20. The method of claim 19, wherein the acute angle is substantially equal to 45 degrees.

21. The method of claim 18, wherein the plurality of light-emitting diodes are arranged in a line having direction extending across the face of the housing perpendicular to the length of the face of the housing.

22. The method of claim 17, further comprising providing a second lamp including a reflector disposed at the second end of the housing, wherein the reflector faces away from the housing at the second end thereof for use as a flashlight.

23. The method of claim 17, further comprising suspending the media player device from a hook formed in the housing at the first end thereof, and wherein the lanyard mount is provided by a hole formed through the hook portion of the housing.

* * * * *